United States Patent [19]

Wernig

[11] 4,105,211

[45] Aug. 8, 1978

[54] GAME OF LOGIC

[76] Inventor: Fred E. Wernig, 65 Cherry St., Massapequa, N.Y. 11758

[21] Appl. No.: 695,010

[22] Filed: Jun. 11, 1976

[51] Int. Cl.[2] ..... A63F 3/00

[52] U.S. Cl. ..... 273/237; 273/265; 273/280

[58] Field of Search ..... 273/1 E, 130 AB, 94 R, 273/135 A; 35/19 A

[56] References Cited

U.S. PATENT DOCUMENTS

| | | | |
|---|---|---|---|
| 1,892,113 | 12/1932 | Morgan | 273/1 E |
| 2,873,971 | 2/1959 | Siegel | 273/94 R |
| 3,466,760 | 9/1969 | Vanek | 35/19 A |
| 3,563,552 | 2/1971 | Korff | 273/135 A |
| 3,690,665 | 9/1972 | Becker | 273/130 AB |
| 3,825,266 | 7/1974 | Bissell | 273/1 E |
| 4,036,500 | 7/1977 | Kiernan | 273/130 AB |

*Primary Examiner*—Robert W. Michell
*Assistant Examiner*—Arthur S. Rose
*Attorney, Agent, or Firm*—Amster, Rothstein & Engelberg

[57] ABSTRACT

The present invention relates to a game of logic which matches the skill and strategy of one player against the other. This game includes a game board having a central display portion wherein a plurality of display devices such as electric lamps are activated by the actuation of the proper combination of switches in the control console at each player's end of the game board. Each switch at one player's console is dependently connected to the corresponding switch at the other player's console and to an electric lamp in such manner that either player can activate or deactivate each lamp in the central display portion of the game board. In play, each player attempts to activate the lamps on the central display area of the game board whereby patterns contained on any of a number of playing cards associated with the Game of Logic are duplicated in the central display area. An alternative embodiment of this game utilizes a different numerical value associated with each lamp in the central display area so that each player can attempt to activate those lamps associated with particular numbers so that the sum of the numbers associated with the illuminated lamps equals the value shown on a playing card.

10 Claims, 13 Drawing Figures

FIG. 1.
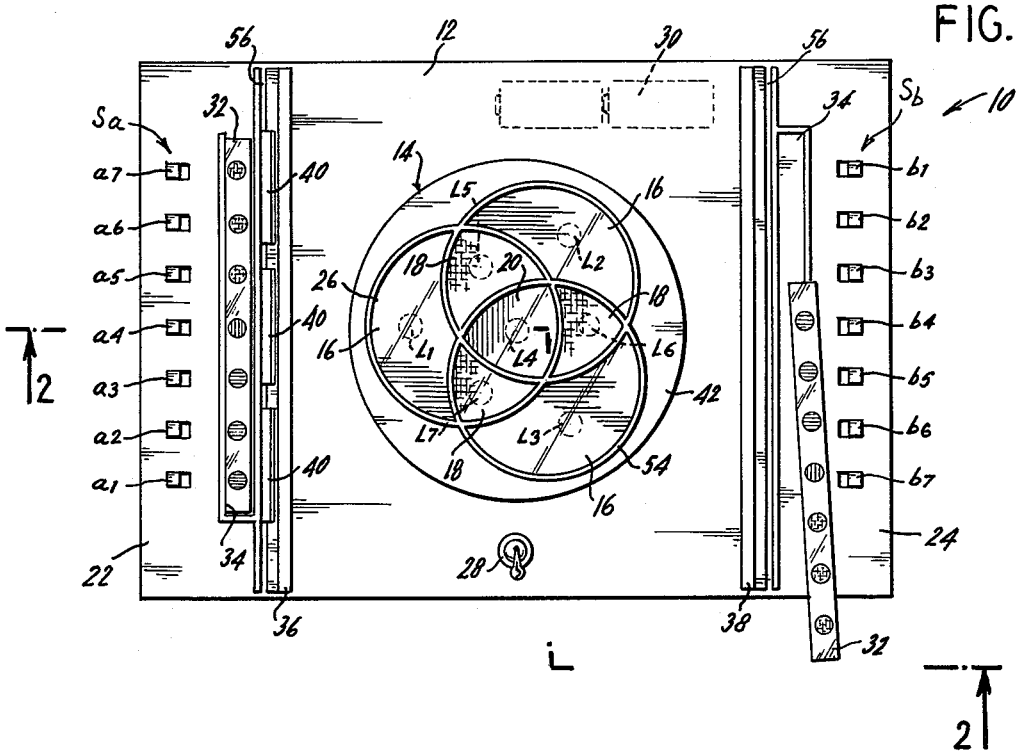
FIG. 2.
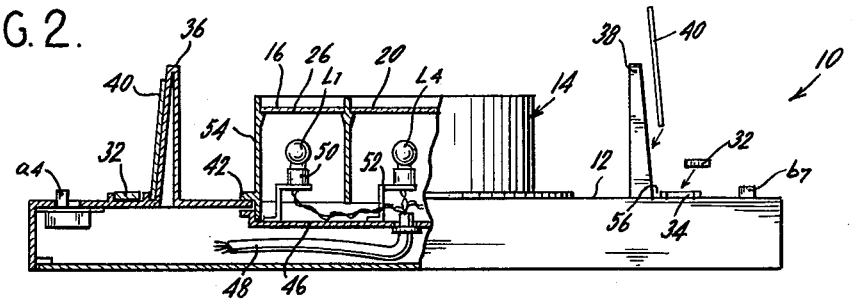
FIG. 3.
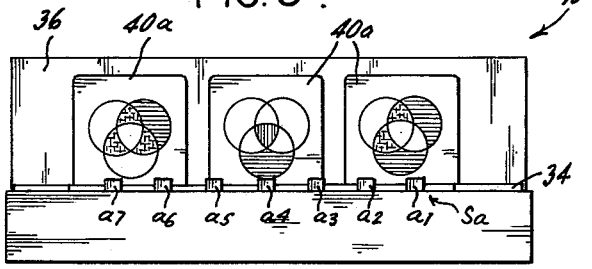
FIG. 4.
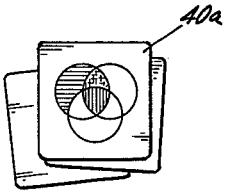
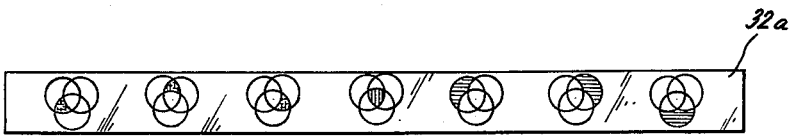
FIG. 5.

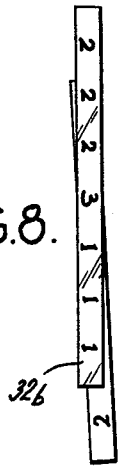
FIG. 8.
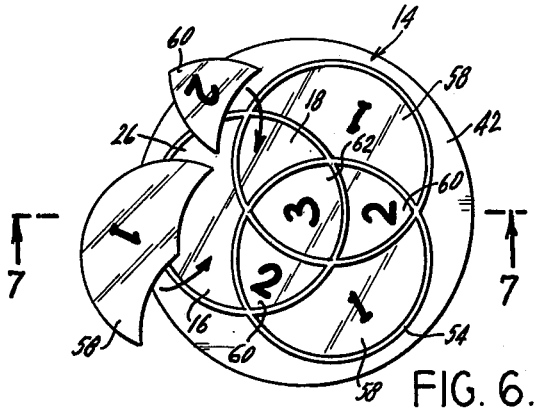
FIG. 6.
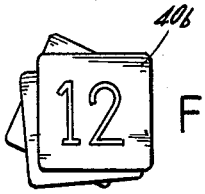
FIG. 9.
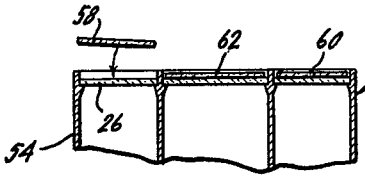
FIG. 7.
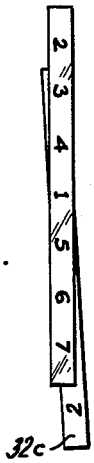
FIG. 11.
FIG. 10.
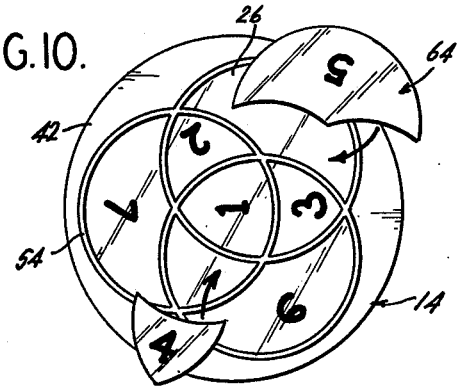
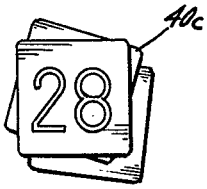
FIG. 12.
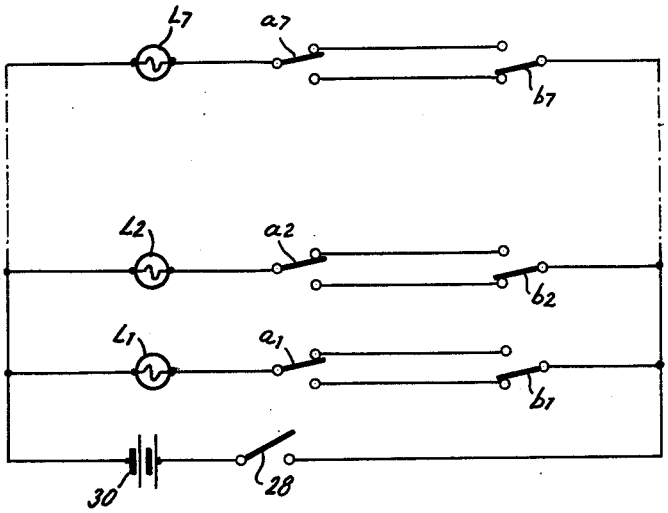
FIG. 13.

GAME OF LOGIC

This invention relates generally to an electrically powered game of logic and, more particularly, to a game which is played by up to two or more players or teams each operating a series of switches controlling the illumination of segments of a display means located at the central portion of the game board in a predetermined manner.

Throughout the years, there have been many games of logic in the marketplace that are specifically designed to be played by a particular segment of the population, such as those disclosed in U.S. Pat. No. 3,563,552 to Korff. Generally, games suited for play by adults cannot be played by children, and games capable of being played by children are not challenging enough to be played by adults.

Further, logic games have either been extremely complex as shown in U.S. Pat. No. 3,770,269 to Elder involving random generators and comparison memory banks and the like or extremely simple as in U.S. Pat. No. 3,367,663 to Marks.

The present invention is related to an electrically powered game board having a multisegmented display area which may be in the configuration of a Venn diagram formed from three intersecting circles and having seven individual segments. Any shaped display area could be utilized as long as it contained multiple segments. Each player is provided with a control console having one switch corresponding to each individual segment of the display. The switches are wired in such manner that the one bulb in each segment of the display unit can be activated or deactivated by any player. In addition, a master switch is provided that adds to the elements of luck, logic and skill required for the successful play of the game by turning off all power to the display area until all the switches are actuated during a particular turn.

The present invention also includes several decks of playing cards for utilization in the play of the game. The first deck contains playing cards having thereon representations of different combinations of illuminated segments of the Venn diagram corresponding to the pattern on the central display area. The second deck contains playing cards with numbers thereon from 1 through 12 and the third deck the numbers from 1 through 28. The first deck is used for adult or expert players and the latter two decks for younger players.

The combination of the illuminated central display area, individual control consoles and playing cards adds a sufficient excitement to the play of this game whereby players of diverse skill and maturity will find the logic game of this invention challenging, interesting and enjoyable.

Accordingly, it is an overall object of the present invention to provide a game of logic which incorporates elements of luck and skill, but is adaptable for challenging and exciting play by players of all age groups. In its commercial form, the game of the present invention is portable, is of relatively simple construction, is readily manufactured by mass production techniques at relatively low cost and includes a number of simple, reliable and relatively indestructible components.

It is a further object of the present invention to provide a game of logic that can be played by one, two or more players or teams of players.

It is a further object of the present invention to provide a game of logic that is educational, easy to learn and challenging for all types of players.

In accordance with an illustrative embodiment demonstrating objects and features of the present invention, there is provided a game of logic which includes a plurality of interdependent control consoles visually isolated from each other. Each of said consoles includes a multiplicity of switching means wherein each switching means includes an on-off control element operatively connected to a corresponding switching means on the other consoles forming interdependent groups of switching means. The logic game is also provided with an energy source and master switching means interruptably connecting the energy source to all of the interdependent groups of switching means and a responsive device having a multiplicity of responsive elements corresponding to the number of switching means in each of the consoles wherein each of the responsive elements are responsibly coupled to each interdependent group of switching means, and a plurality of play directing means.

The object of play of the present invention is for one player, during alternating turns to move two of the switches on his control console while the master switch is in the "off" position thereby causing lamps in the central display area to become activated, or deactivated, when the master switch is returned to the "on" position. The patterns shown on the particular playing cards are thereby duplicated by the illuminated segments of the central display area. Beginner or younger players activate switches in an attempt to illuminate the particular segments of the display area corresponding to particular numerical values printed on the individual segments so that the sum of the numbers illuminated equals the number printed on a particular playing card. Finally, intermediate players utilize inserts containing higher numbers and a correspondingly higher numbered deck of cards.

In all types of play, the excitement of competition is provided by the interdependency of the control consoles of the players. In the preferred form of this invention, either player's console is capable of independently activating or deactivating any lamp in the central display unit. Therefore, whenever one player, Player A, requires more than one turn to activate the necessary number of light bulbs to duplicate the particular pattern, the other player, Player B, during his intervening turn may deactivate any of the lamps originally lit by Player A or activate other lamps thereby frustrating the attempt of Player A to duplicate a particular pattern. The interplay between Players A and B affects the play of the game using numbered decks in a similar manner.

The above description, as well as further objects, features and advantages of the present invention will be more fully understood be reference to the following detailed description of the presently preferred, but nonetheless illustrative embodiment in accordance with the present invention, when taken in conjunction with the accompanying drawings, wherein:

FIG. 1 is a top plan view of the representative form of the game of the present invention, illustrating two control consoles and the central display area;

FIG. 2 is a side elevational view, with parts broken away and in section, illustrating the details of construction of the central display area and the visually isolating barriers adjacent each control console;

FIG. 3 is an end elevational view showing the playing cards positioned along the visual barrier at one control console;

FIG. 4 shows a typical playing card of the deck containing patterns that may be duplicated by a particular player on the central display area, wherein the shadings indicate the colors red, yellow and blue;

FIG. 5 shows a typical switch indicating card which is placed in a channel adjacent the switches at each player's control console which is specifically adapted to be used with the playing cards shown in FIG. 4;

FIG. 6 is a top plan view of the central display unit showing inserts containing the numbers "1", "2" and "3" that may be placed in the various segments of the central display unit for modification of the present invention;

FIG. 7 is a sectional view, taken substantially along the line 7—7 in FIG. 6 and looking in the direction of the arrows, illustrating the positioning of the inserts in the various segments of the central display unit;

FIG. 8 shows the switch indicating cards for use with the inserts shown in FIG. 6;

FIG. 9 shows a typical playing card in the deck of cards for use with the inserts shown in FIG. 6;

FIG. 10 is a top plan view of the central display unit showing inserts containing the numbers "1" through "7" for another modification of the present invention;

FIG. 11 shows the switch indicating cards for use with the inserts shown in FIG. 10;

FIG. 12 shows a typical playing card in the deck of cards for use with the inserts shown in FIG. 10; and FIG. 13 is a schematic diagram of a circuit used in the preferred form of the game of logic of the present invention.

Referring now specifically to the drawings and in particular to FIG. 1, there is shown an illustrative game embodying features of the present invention generally designated by the reference numeral 10, which includes a game board 12 having a central display area generally designated by the reference numeral 14. The central display area is shaped in a Venn diagram formed by three intersecting circles forming three outer segments 16, three intermediate segments 18 and one central segment 20.

Each end of the game board 12 contains a control console 22, 24. Located on each control console are a plurality of switching means S*a*, S*b* corresponding to the number of segments in the central display area 14.

A master switch 28 connects the power source 30, shown as a series of dry cells under the surface of game board 12, however, it is contemplated that the power source 30 could be a transformer or similar power supply means capable of being plugged into house current and thereby providing safe, low voltage electrical power for playing the game.

Each switching means S*a* on the first control console 22 is connected to the corresponding switching means S*b* located in the second control console 24. The electrical power from the power source 30 passes through master switch 28 to each interconnected pair of switching means *a*1, *b*1 to corresponding light bulb L1.

As indicated by the shading in FIG. 1, each segment of the Venn diagram portion of the central display area 14 has translucent top portion 26 of different colors. Thus, when each lamp L is turned on the particular top portion 26 associated with that lamp becomes illuminated in the particular color. Specifically, the outer segments 16 contain translucent top portions 26 that are blue, the intermediate segments 18 appear yellow and the central segment 20 appears red. A switch indicator card 32, located within a formed recess 34 at each control console 22, 24, identifies to each player the color of the particular segment of the central display area 14 that will be illuminated by the actuation of a particular switch. As shown in FIG. 1, pairs of switches *a*1, *b*1; *a*2, *b*2; *a*3, *b*3 actuate lamps L1, L2, L3, respectively, thereby causing outer segments 16 to become lighted in the blue color of the translucent top portions 26. Similarly, the pair of switches *a*4, *b*4 actuate lamp L4 in the central segment 20 which will be illuminated in red color. Finally, switch pairs *a*5, *b*5; *a*6, *b*6; *a*7, *b*7 control lamps L5, L6 and L7, respectively, which cause intermediate segments 18 to become illuminated in the yellow color. Each switch indicator card 32 contains a color indicator informing the respective players as to which color segment will be actuated.

FIG. 2 shows a partial cutaway of game board 12 and the central display area 14. Upstanding barriers 36, 38 located at the first control console 22 and the second control console 24, respectively, provide a means whereby each player's switches are visually isolated from the other player so that each player's moves are secret. The barriers, 36, 38 also serve to support play indicating cards 40 so they will only be visible to one player. As will be more fully described below, these play directing or indicating cards are used to indicate to the respective players what patterns must be duplicated by the illumination of the necessary segments of the central display area 14 in order to win the game.

The cutaway area of FIG. 2 shows the internal construction details of one embodiment of a central display area 14. It is possible to form the display portion three intersecting cylinders projecting upwardly from a circular flange 42 although molding the display portion in a single piece is preferred. The vertical upstanding portion of the display area has a downwardly extending cylindrical extension 44 beyond circular flange 42 which extends through the top surface of game board 12. The central display area 14 is restrained within the top of the game board 14 by a hat-shaped retainer 46 fastened to cylindrical extension 44 allowing the central display area 14 to be rotatable in both the clockwise and counterclockwise direction (as shown in FIG. 1) relative to the top surface of game board 12 to prevent a player from "learning" the board. That is, before the start of a game the central display area 14 is rotated in either direction up to approximately 120° from the neutral position thereby reorienting the Venn diagram in such manner that lamps, L1, L2, L3 and lamps L5, L6 and L7 have moved to the next adjacent position of the direction of rotation of the central display area 14. The variation of the switches seemingly connected to each segment is accomplished without requiring modification to the electrical interconnections between control consoles 22, 24 and the central display area 14.

To facilitate the rotation of the display area 14 plus or minus 120° from the neutral position the lamps L in the central display area 14 are connected to switches S*a*, S*b* by a cable 48 entering the bottom portion of the central display area 14 through the center of the hat-shaped retainer 46. Each lamp L is held in a socket 50 which is mounted on a bracket 52 attached to the hat-shaped retainer 46.

As best shown in FIG. 2 the game board is shaped to be readily manufactured by molding or a similar mass production technique. The central display area 14 although effectively made of three intersecting cylinders can preferably be formed in a commercial embodiment of this invention as a single piece by the molding. Upstanding walls 54 forming the central display area 14 are made of opaque material such that the light from a particular lamp L is channeled upward through the colored, translucent top portions 26 of each segments 16, 18, 20 of the central display area 14.

Switch means S*a*, S*b* shown in FIG. 2 as individual slide switches are capable of being molded into the game board 12 for economy of production. Similarly the switch means could be of the toggle or equivalent type.

FIG. 3 shows an end view of the game board 12 with upstanding barrier 36 and first control console 22 visible.

In the primary form of the game of the present invention, the play indicating cards 40 are of the form shown by play directing or indicating cards 40*a* in FIG. 4. This form of the game is specifically adapted for play by adults. Each card 40*a* contains a representation of a Venn diagram in which all or some of the various segments are colored as shown by the hatch lines in FIG. 4 to indicate that the particular segment has been illuminated. During the play of the game each player selects several play directing cards 40*a* and places them in the card receiving channel 56 at the base of barrier 36, 38 at his control console 22, 24. The card 40*a* rests against barrier 36, 38 and remains in a substantially upright position in view of only one player. The object of the game is for each player to duplicate any of the Venn diagrams shown on the cards placed before him on the central display area 14. Normally, the switch indicator card 32 in the form shown in FIG. 1 is used in this form of a game. If the players, however, are less experienced the switch indicator card 32*a* shown in FIG. 5 can be placed in the formed recess 34 at each control console 22, 24. Switch indicator card 32*a* informs the player which particular segment of the central display area 14 is controlled by each switch S*a*, S*b* when the central display area 14 is in the neutral position.

To adapt the game of this invention to be played in its simplest form, the mmaterials shown in FIG. 6, 8 and 9 are provided. Precut translucent inserts 58 each bearing the numeral "1" thereon provided with the game of the present invention are inserted into the respective outer sgements 16 of the central display area 14. Whenever lamps L1, L2 or L3 are activated the translucent inserts 58 are similarly illuminted. A second set of precut inserts 60 bearing the numeral "2" are provided for insertion within the intermediate segments 18 and a single precut transclucent insert 62 bearing the numeral "3" is provided for insertion in the central segment 20 as shown in FIG. 6.

FIG. 7 shows the particular placement of inserts 58, 60 and 62 over the translucent top portions 26 of outer segments 16, intermediate segments 18 and central segment 20, respectively. When inserts 58, 60 and 62 are utilized the switch indicator cards 32 in the form of the cards 32*b* shown in FIG. 8 are utilized. These cards 32*b* indicate the numeral appearing on inserts 58, 60, 62 which will be illuminated in the central display area 14 when the corresponding switch S*a*, S*b* is actuated. The play directing or indicating cards 40 utilized for this form of a game are shown in FIG. 9 as the cards 40*b*. Cards 40*b* contain the numerals from "1" through "12". The object of the play of this form of the game is for a particular player to activate the proper switches S*a*, S*b* to cause the proper combination of inserts 58, 60, 62 to be illuminated so that their arithmetic sum will equal to the total shown on a particular play indicating card 40*b*.

Another form of this game is shown by the materials in FIGS. 10, 11 and 12. In this form precut, translucent inserts 64 bearing the numerals from "1" through "7" are provided for placement over the translucent top portion 26 of the central display area 14. These inserts replace the inserts 58, 60, 62 shown in FIGS. 6 and 7 in the same manner as set forth in FIG. 7. Switch indicator cards 32 in the form shown by the cards 32*c* in FIG. 11 are placed in the formed recess 34 at each control console 22, 24. Similarly, a deck of play indicating cards 40 in the form shown by the cards 40*c* in FIG. 12 are utilized. The cards 40*c* contain the numerals from "1" through "28". The object of this form of the game is, again, to illuminate the segments of the central display area 14 containing inserts 64 bearing numerals whose arithmetic sum equals that value shown on a particular play indicating card 40*c*.

FIG. 13 shows a schematic diagram of the circuit used in the preferred form of the game of this invention. The switching means S*a*, S*b* are of the single pole, double throw configuration, and wired in such manner that a switch, i.e. *a*1 on the first control console 22, is interdependently connected to the corresponding switch *b*1 on the second control console 24 and then to the corresponding lamp L1. Either player, by activation of his switch alone, can turn any segment of the central display area 14 on or off. When the game is played by adults or experienced players, the master switch 28 is placed in the "off" position while both players activate the predetermined number of switches in their control consoles 22, 24. The master switch 28 is then turned on and those lamps activated by the respective players, unless cancelled by the deactivation by the opposing player, will become illuminated. By utilizing single pole, double throw switches S*a*, S*b* and the circuit shown in FIG. 13, it is possible that in some circumstances a lamp L will be illuminated by the forward motion of a switch S*a*, S*b* or by the backward motion of a switch S*a* depending upon whether the opponent has activated the other switch S*b* in the interdependent pair of switches. It would be possible to modify the interconnection and type of switches to provide more than two consoles.

Although the present invention utilizes a central display area 14 having seven segments and correspondingly seven lamps L, and seven sets of interdependent pairs of switches S*a*, S*b* it is possible to incorporate a central display area having a larger number of segments. In such instance a corresponding number of lamps and switch pairs need only be added to the circuit shown in FIG. 13.

The primary form of the game of this invention utilizes the play indicating cards 40*a* containing the representations of the various Venn diagram figures. More advanced players utilize the switch indicator cards 32 of the configuration shown in FIG. 1. Prior to the commencement of play all switching means S*a*, S*b* are switched so that all lamps L in the central display area 14 are turned off.

Play is commenced as follows: Each player draws a predetermined number of play indicating cards 40*a* and places them against barrier 36, 38 adjacent his control console 22, 24. With the master switch 28 in the "off" position, each players activates switches S*a*, S*b* he feels will light the areas in the Venn diagram corresponding to any of the patterns on the play indicating cards 40. The master switch 28 is activated and if a player has a play indicating card 40*a* that matches the lighted pattern on the central display area 14, he places it on a pile in front of him and picks another play indicating card from the center stack. If no play indicating card 40*a* held by either player corresponds to the Venn pattern illuminated on the central display area 14 the master switch 28 is turned off and the Player A may move a maximum of two switches S*a* in the first control console 22 to try to illuminate a pattern on the central display area 14 that will match one of his play indicating cards 40*a*. After the switches are activated, the master switch 28 is turned on and the illuminated pattern on the central display area 14 is compared to each player's play indicating cards 40*a*. Next, the master switch is turned off and Player B moves up two switches S*b* on the second control console 24. The master switch 28 is turned on and the play indicating cards 40*a* again compared. The game continues in this manner until one player has no more play indicating cards 40*a* and the winner is the player who has matched the most play indicating cards 40*a* with the illuminated pattern on the central display area 14.

In another variation of play, the play indicating cards 40 can be dealt face up between each player instead of with the play indicating cards 40 placed against barriers 36, 38 so they will not be in view of the opponent. To avoid one player becoming familiar with which switches S*a*, S*b* correspond to the particular segments of the central display area 14, the central display area 14 is adapted to be rotatable plus or minus 120° from the neutral position. Prior to the commencement of play a third person can rotate the central display area to a different position so the players will not be able to correlate the switches S*a*, S*b* with the particular segments of the central display area 14.

The game of the present invention can also be played by or with children in a manner that is both fun and educational. Translucent inserts 58, 60, 62 are placed over the translucent top portion 26 of the particular segments in the central display area 14 as described above. The player or players then attempt to illuminate the particular segment whose number designations will add up to the figures shown on the play indicating card 40*b*. For older children, the translucent inserts 64 bearing higher numbers are placed within the particular segments of the central display area 14. The play indicating cards 40*c* are then utilized and play of the game commences substantially along the lines set forth above for play using the Venn pattern play indicating cards 40*a*. The players alternate turns attempting to illuminate the particular segments with number designations whose sum will equal the numbers appearing on the play indicating cards 40*c* held by either player or dealt face up between the players.

To use the game of the present invention in a strictly educatinal manner, as adult or older child can use play indicating cards 40*b* or 40*c* as flash cards. The player activates switches S*a* on his control console 22 to illuminate the proper segments bearing inserts 58, 60, 62 or inserts 64, respectively, to equal the sum shown on the play indicating cards. To add variety an additional requirement may be made that the player illuminate only a particular number of segments of the central display area 14 to equal the value shown on the play indicating card.

A latitude of modification, change and substitution is intended in the foregoing disclosure. Accordingly, it is appropriate that the appended claims be construed broadly and in a manner consistent with the spirit and scope of the invention.

What is claimed is:

1. A game of logic for a plurality of players comprising: a first and second interdependent control console, means visually isolating said first and second control console from each other, each of said consoles including a multiplicity of switching means, each of said switching means including a single pole-double throw control element operatively connected to a corresponding switching means on said other console forming a multiplicity of interdependent pairs of switching means, an energy source, means connecting said energy source to all of said interdependent pairs of switching means, a responsive device formed in the shape of three intersecting circles and defining a multiplicity of on-off indicating segments having a corresponding activatable responsive element at each said segment and corresponding to the number of interdependent pairs of switching means, each of said activatable responsive elements responsively coupled to one of said interdependent pairs of switching means in such manner that operation of either switching means activates or deactivates said responsive element interdepending upon the operation of the other switching means of each interdependent pair of switching means and master switching means interruptably connecting said means connecting said energy source to all of said interdependent pairs of switching means, and a plurality of individual play directing playing cards mountable on said playing board.

2. A game of logic as recited in claim 1 wherein said multiplicity of responsive elements are comprised of light means.

3. A game of logic as recited in claim 2 wherein each switching means on one of said consoles is operably connected to a corresponding switching means on the other control console and to a corresponding light means in said responsive device.

4. A game of logic as recited in claim 1 wherein said visually isolating means are comprised of an upstanding wall on each control console adjacent said switching means whereby each console is visually isolated from each other console.

5. A game of logic as recited in claim 1 wherein said responsive device is comprised of a pattern of individually indicatable segments rotatably orientable to three different visually identical orientations symetrical about the center of said pattern.

6. A game of logic as recited in claim 5 wherein said play directing playing cards are comprised of pattern indicating playing cards.

7. A game of logic as recited in claim 1 wherein said responsive device is comprised of a plurality of number indicating segments.

8. A game of logic as recited in claim 7 wherein said play indicating playing cards are comprised of a plurality of number indicating playing cards.

9. A game of logic for a plurality of players comprising: a first and a second interdependent control console, means visually isolating said first control console from said second control console, said first control console including a multiplicity of switching means, each of said switching means including a single pole double throw switch element operatively connected to a corresponding single pole double throw switch element on said second control console forming an interdependent pair of switching means, an energy source, means connecting said energy source to each of said interdependent pairs of switching means, a rotatable responsive device having the shape of three intersecting circles defining a multiplicity of indicating segments and rotatable about the center of said three circles into three visually similar orientations and a multiplicity of responsive elements one of said elements located in each one of said indicating segments and having an on condition and an off condition and each said responsive element corresponding to one interdependent pair of switching means and responsively coupled to said interdependent pair of switching means whereby said switch element on either said first control consol or said second control console can place said coupled corresponding responsive element in either said on condition or said off condition, and a plurality of play directing playing cards.

10. A game of logic as recited in claim 9 further including master switching means interruptably connecting said means connecting said energy source to each of said interdependent pairs of switching means.

* * * * *